United States Patent [19]

Ikenberry

[11] Patent Number: 4,475,373

[45] Date of Patent: Oct. 9, 1984

[54] HYDRAULIC POWERED PIPE AND TUBING STRAIGHTENER

[76] Inventor: Maynard D. Ikenberry, Cottonwood Village, Quinter, Kans. 67752

[21] Appl. No.: 359,417

[22] Filed: Mar. 18, 1982

[51] Int. Cl.[3] ..... B21D 3/14; B21D 41/02

[52] U.S. Cl. ..... 72/392; 72/393; 254/104; 254/124

[58] Field of Search ..... 72/392, 393; 254/104, 254/124, 9 C; 29/239

[56] References Cited

U.S. PATENT DOCUMENTS

| | | | |
|---|---|---|---|
| 1,157,073 | 10/1915 | Baash | 72/392 |
| 1,407,719 | 2/1922 | Boner | 254/104 |
| 1,623,405 | 4/1927 | Gocke et al. | 72/392 |
| 1,623,657 | 4/1927 | Brown | 72/392 |
| 2,687,763 | 8/1954 | Perkins | 72/392 |
| 2,780,122 | 2/1957 | McCown | 72/392 |
| 3,710,609 | 1/1973 | Jones | 72/392 |
| 4,004,444 | 1/1977 | Pollart | 72/392 |
| 4,068,825 | 1/1978 | MacPherson | 254/124 |

FOREIGN PATENT DOCUMENTS

| | | | |
|---|---|---|---|
| 399704 | 7/1924 | Fed. Rep. of Germany | 72/392 |

*Primary Examiner*—Lowell A. Larson

*Attorney, Agent, or Firm*—Robert E. Breidenthal

[57] ABSTRACT

A pipe straightening tool that includes an operating unit that can be inserted forwardly in a pipe as far as needed by use of detachable handle extensions. The unit includes an elongated lower segment and a parallel upper segment thereabove having a nose segment pivoted at its forward end for movement of the forward tapered end of the nose segment toward and away from the tapered forward end of the lower segment. The upper unit is movable toward and away from the lower segment on operation of a pair of connecting toggle linkages having a common actuator. A hydraulic cylinder unit is disposed between and connected to the actuator and another toggle linkage connecting the lower and nose segments so that extension of hydraulic cylinder unit concurrently urges upward movement of both the upper segment and the nose segment. All the segments present outwardly facing surfaces that are conformable to cylindrical surfaces. Boots can be attached to the segments to increase the effectiveness of the tool for larger pipe. A manually operative hydraulic pump contributes substantially to the portability of the tool, such pump being connected to the hydraulic cylinder by a flexible hydraulic fluid line.

15 Claims, 11 Drawing Figures

FIG. 1
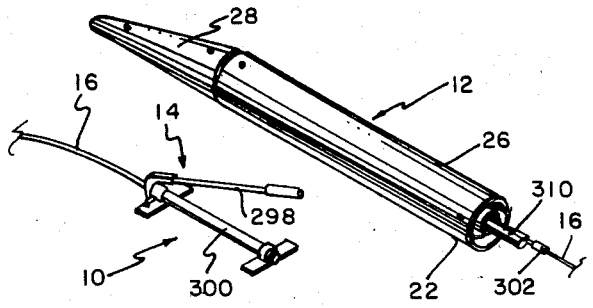
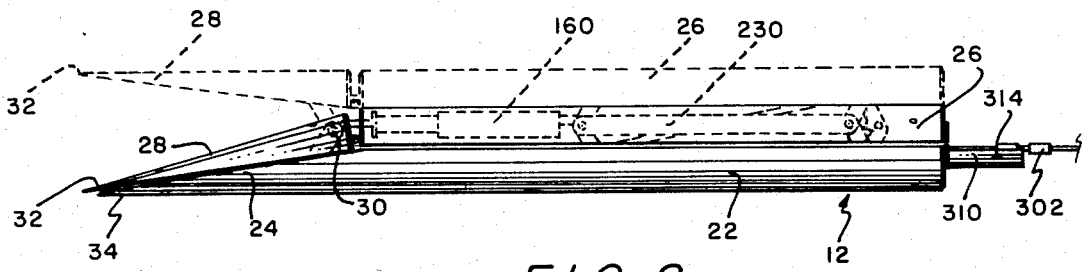
FIG. 2
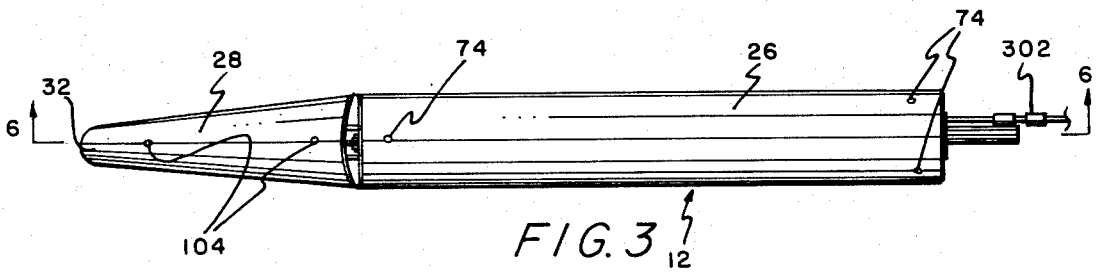
FIG. 3
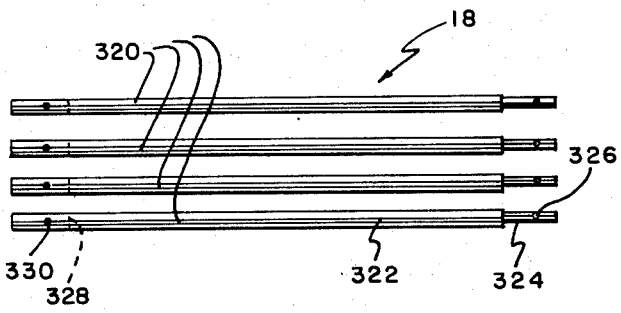
FIG. 4
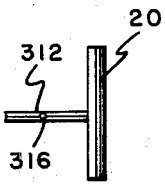
FIG. 5

FIG. 9
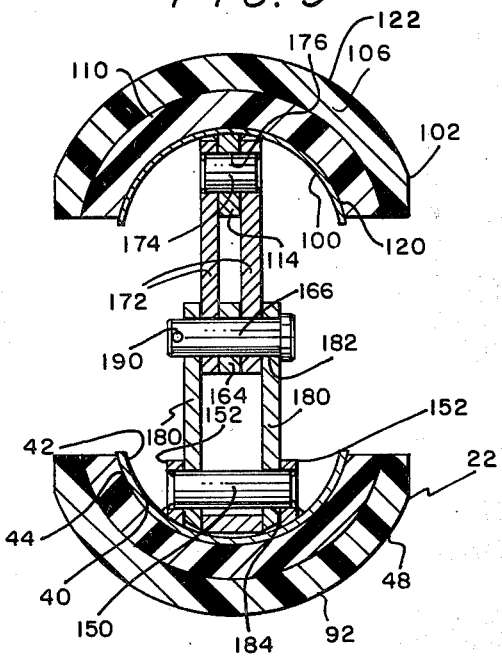
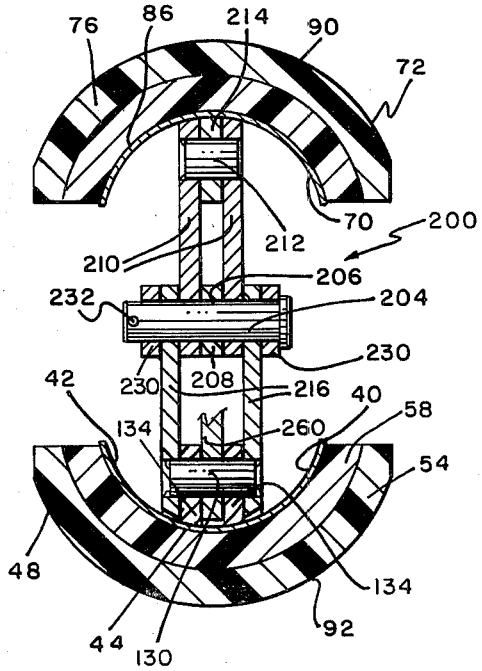
FIG. 10
FIG. 11
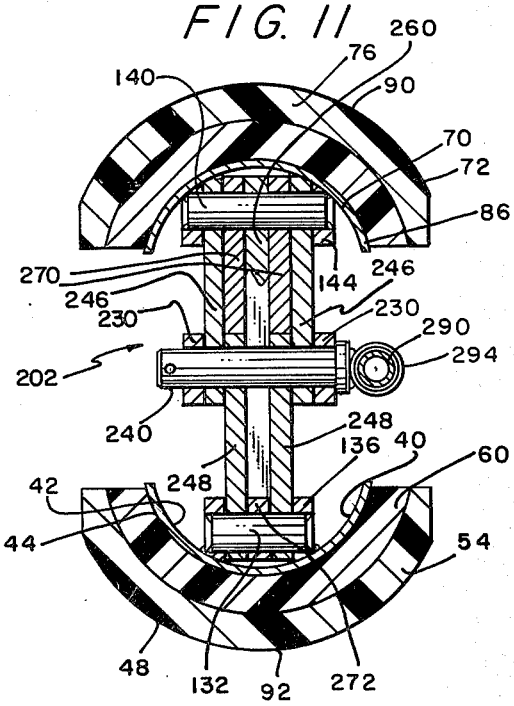

HYDRAULIC POWERED PIPE AND TUBING STRAIGHTENER

The present invention relates to new and useful improvements in tools for straightening pipes that have become dent or bent, and more particularly pertains to such a tool than can be hydraulically expanded within relatively lightweight pipe such as aluminum irrigation pipe or steel grain auger tubes to force indented or crinkled portions of the pipe outwardly toward its initial generally cylindrical configuration.

A background appreciation of prior art proposals having to do with repairing dented pipes and the like may be obtained on inspecting the following U.S. Pat. Nos.:

| | | |
|---|---|---|
| 2,780,122 | McCown | Feb. 5, 1957 |
| 3,817,079 | Priester | June 18, 1974 |
| 3,710,609 | Jones | Jan. 16, 1973 |
| 3,747,394 | Cunningham | July 24, 1973 |
| 2,341,278 | Long | Feb. 8, 1944 |
| 2,687,763 | Perkins | Aug. 31, 1954 |
| 4,004,444 | Pollart | Jan. 25, 1977 |
| 1,157,073 | Baash | Oct. 19, 1915 |
| 1,623,405 | Gocke et al | Apr. 5, 1927 |
| 3,749,365 | Van Gompel | July 31, 1973 |

The McCown and Priester patents suggest pivotally urging by hydraulic means a shaped member against a dent to force the same outwardly.

The Jones and Cunningham patents suggest the use of a common bar connected to a plurality of toggle linkages for urging diametrically opposed elements into pipe engagement.

The Long patent suggests employment of hydraulic means and toggle links to force diametrically opposed outward pivotal movement of a pair of work engaging shoes.

The Perkins patent suggests the use of a pair of semi-cylindrical shoes and means for urging them apart against opposite sides of a pipe.

The Van Gompel patent as well as the others listed above are only seen to be of incidental interest to the present invention and to provide an understanding of somewhat related earlier efforts made in the field.

The paramount object of the present invention is to provide a tool capable of providing both pivotal and radial or radial forces against pipe dents, and wherein radial forces are applied so as to preclude longitudinal movement of the tool when pivotal forces are applied.

A related objective is to provide a tool such that the forces applied pivotally and radially are a function of each other.

A broad aspect of the subject invention involves a pipe straightening tool comprising an elongated and horizontally extending unit that includes a lower segment having a lower external surface that is conformable to a downwardly convex cylindrical surface of a given diameter, said unit also including an upper segment parallel to and disposed directly above a rear portion of the lower segment and having an upper external surface that is conformable to an upwardly convex cylindrical surface of said diameter, means operatively connecting the upper segment to the lower segment for movement of the former between an elevated extended position and a depressed retracted position relative to the latter while maintaining such segments in parallelism to each other, a first means for urging movement of the upper segment toward its extended position, said upper and lower segments having an overall vertical extent that is less than said diameter when the former is in its retracted position, said unit also including an elongated nose segment directly overlying the forward portion of the lower segment and having a rear end pivotally connected to the front end of the upper segment for swinging movement thereof between a relatively raised position in which its upper external surface is conformable to the same upwardly convex surface as the upper segment and a relatively lowered position in which the nose section is inclined downwardly and forwardly from the forward end of the upper segment, a second means for urging movement of the nose segment from its lowered toward its raised position, and the nose segment and the portion of the lower segment disposed therebelow being tapered forwardly so that the forward end extremities of such segments are in relatively close proximity when the nose segment is in its lowered position.

Other objectives, aspects, features and advantages of the invention will become apparent in the light of the following description of a preferred embodiment of the invention which is given in conjunction with the accompanying drawings, wherein:

FIG. 1 is a broken perspective view of the tool of the invention, the same being shown in its retracted or collapsed condition;

FIG. 2 is a side elevational view of the operating unit, the same being shown in partially broken away full lines in its retracted condition and in dashed lines in its extended or expanded condition;

FIG. 3 is a top plan view of the operating unit;

FIG. 4 is a plan view of a set of handle extensions for the operating unit;

FIG. 5 is a plan view of a handle for use with the extensions shown in FIG. 4;

FIG. 9 is a transverse sectional view taken upon the plane of the bent section line 9—9 in FIG. 7;

FIG. 10 is a transverse sectional view taken upon the plane of the bent section line 10—10 in FIG. 7; and, FIG. 11 is a transverse sectional view taken upon the plane of the bent section line 11—11 in FIG. 7.

Figure 6:
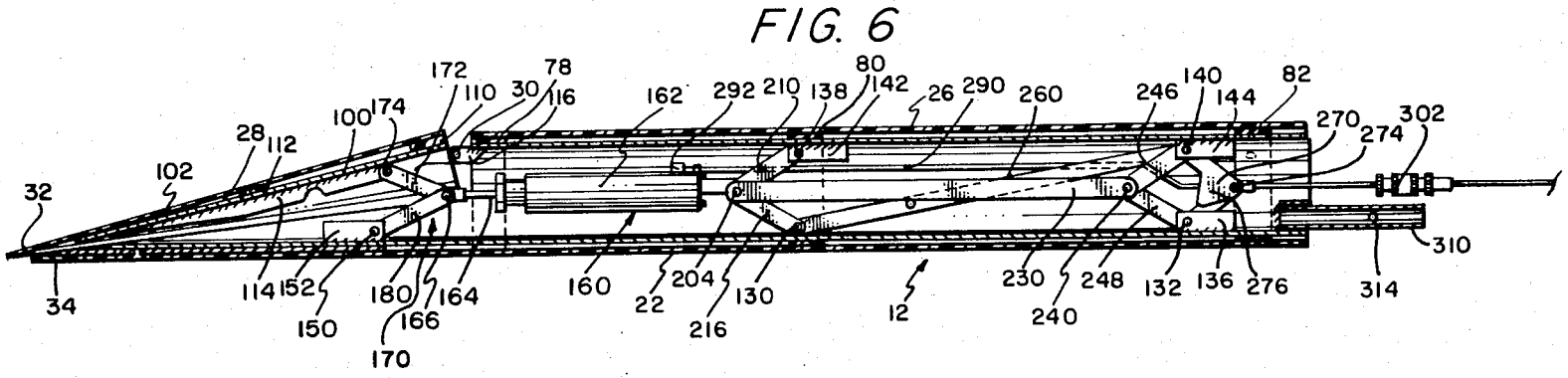
FIG. 6 is a vertical longitudinal sectional view of the operating unit in retracted condition taken upon the plane of the section line 6—6 in FIG. 3, with the hydraulic power unit being shown in full lines.

Referring now to the drawings wherein like numerals designate like parts throughout the various views, the reference numeral 10 designates the tool generally, the same being comprised of an operating unit designated generally at 12. A manually operable hydraulic pump designated generally at 14 is connected to the operating unit 12 by an elongated flexible hydraulic fluid line 16. The tool 10 is also provided with a set of handle extensions designated at 18 in FIG. 4 and a handle 20 in FIG. 6 that can be coupled to the operating unit 12 for manipulating the position of the latter in a damaged pipe, not shown.

The operating unit 12 is comprised of three relatively movable segments, namely, an elongated lower segment 22 that is tapered at its forward end portion as indicated at 24, an elongated upper segment 26 that is parallel to and directly overlies the rear portion of the lower segment 22, and a forwardly tapered nose segment 28 that directly overlies the forward portion of the lower segment 22 and which is pivotally connected at its rear end at 30 to the forward end of the upper segment 26 so that the transversely and vertically reduced forward extremity 32 of the nose segment 28 can swing vertically above a position of close proximity to the transversely and vertically reduced forward extremity 34 of the lower segment 22.

The lower segment 22 is comprised of a steel shell or hull 40 of uniform wall thickness having inner and outer surfaces 42 and 44 which are each of or compatible with a circular cylindrical configuration. Indeed, the shell or hull 40 can be conveniently fabricated or cut from a length of circular steel pipe, not shown, of sufficient wall thickness to afford the strength or stiffness required (see FIG. 9). Optionally, the lower segment 22 includes, as shown, a boot 48 that is detachably secured to the hull 40 by recessed screws 50. The boot 48 has an external configuration generally similar to that of the hull 40 and presents a downwardly facing convex outer surface 92 that is substantially conformable to a circular cylindrical surface configuration.

The boot 48, as shown, can be constituted of a shell 54 of uniform wall thickness with a longitudinally extending rib 56 attached thereto along its forwardmost extent to serve as a spacer between the shell 54 and the hull 40. The boot 48 and the spacer rib 56 thereof are preferably of a tough plastic or synthetic resin material such as polycarbonate and are essentially of integral character as they are cemented together by a suitable adhesive. A pair of spaced arcuate spacers 58 and 60 of similar material are cemented to the shell 54 to constitute essentially integral components of the boot 48, such spacers 58 and 60 being interposed between the shell 54 of the boot 48 and the hull 40. The screws 50 attaching the boot 48 to the hull 40 extend through both the shell 54 and the intervening spacers 56 and 60 into the hull 40.

The upper segment 26 is generally similar to the lower segment 22 and includes a steel hull 70 (which may be economically cut or fabricated from the same length of steel pipe as the hull 40), to which a boot 72 is optionally attached by screws 74. The boot 72 is quite similar to the boot 48 and is comprised of a shell 76 to which arcuate spacers 78, 80 and 82 are attached by a suitable cement so that the boot 72 is an essentially integral structure. The screws 74 extend through the shell 76 and the spacers 78 and 82 into the hull 70.

The outer or upper surface 86 of the hull 70 is convex viewed from above and is conformable to a circular cylindrical surface of the same diameter as that of the convex (viewed from below) outer surface 44 of the hull 40. The outer surface 90 of the boot 72 is convex (viewed from above) and is conformable to a circular cylindrical surface of the same diameter as is the outer convex surface 92 of the shell 54. Except upon the occurrence of some extraordinary repair problem, it is to be noted that if either of the boots 48 and 72 is to be used or mounted on the hulls 40 and 70, then both will ordinarily be used to increase the effective radii of the hulls 48 and 70.

The nose section 28 includes a tapered steel hull 100 that can, along with the hull 70, be cut or fabricated from the same length of steel pipe from which is fabricated the hull 40. As in the case of the hulls 40 and 70, the hull 100 can be provided with a boot 102 detachably secured thereto by screws 104. The boot 102 is comprised of a shell 106 of the radial dimensions as the shells 54 and 76. Indeed, it may be instructive at this point to note that the shell 54 can be fabricated or cut from a length of circular tubular stock, and that the shells 76 and 106 can be cut or fabricated from the same length of stock from which the shell 54 is fabricated, with attendant economy of materials as well as of fabrication cost and effort. An arcuate spacer 110 is cemented to the rear end of the shell 106 and such spacer 110 seats against the hull 100 as shown in FIG. 9. Another spacer 112 is cemented to the shell 106 and seats against the hull 100.

A tapered steel spline or rib 114 is welded to the underside of the hull 100 along the longitudinal medial plane of the latter in depending relation therefrom to afford reinforcement therefor.

A pair of steel plates 116 are welded to the hull 70 to project forwardly thereof as shown in FIG. 6. The rear end of the rib is apertured and journaled on the pivot pin 30 with the opposite ends of the pin 30 being welded to the plates 116 between which it extends. It will be understood that the spacing of the plates 116 is essentially the same as the thickness of the rib 114 so as to slidingly and guidingly engage the same during vertical swinging movement of the nose segment 28 about the transverse horizontal axis of the pivot 30 as indicated by the dashed arrow 118 in FIG. 7. The arrangement is such that the forward extremities of the lower 22 and nose 28 segments can be in close proximity to each other (whether the boots 48 and 102 are attached or not) when the nose segment 28 is swung downwardly. The arrangement is also such that the nose segment 28 can be swung to a raised horizontal position such as shown in full lines in FIG. 7 such that the upper surface 120 of the hull 100 constitutes a continuation of the upper surface 86 of the hull 70, and with the upper surface 122 of the boot 102 constituting a continuation of the upper surface 90 of the boot 72.

It will be understood that the boot 102 is attached to the hull 100 ordinarily only when the boot 72 is attached to the hull 70.

Longitudinally spaced and transversely extending horizontal pivot pins 130 and 132 are secured to the upper side of the hull 40 by means of spaced pairs of plates 134 and 136 that are welded to the hull 40, with the pivot pin 130 being journaled through the plates 134. The end extremities of the pivot pin 132 are welded to the plates 136 between which it extends. In a similar fashion a transverse and horizontally extending pivot pin 140 is fixed to the hull 70 by means of parallel plates 144 welded to the hull 70. The end extremities of the pivot pin 140 are welded to the plates 144 between which it extends. As shown in FIG. 6, all the pins 130, 132 and 140 are parallel to each other, with the pin 140 being disposed directly above the pin 132.

Another transverse and horizontally extending pivot pin 150 is fixed centrally to the hull 40 and is disposed below a rear portion of the nose segment 28; the pin 150 being mounted by means of a pair of spaced plates 152 welded to the hull 40 with the opposite extremites of the pin 150 being welded to the plates 152 between which it extends.

A conventional hydraulic power unit designated generally at 160 is provided that includes a cylinder 162 from which a piston rod 164 slidably extends. A horizontal pivot pin 166 transversely extends through an apertured front end portion of the piston rod 164. A toggle linkage designated generally at 170 is provided which comprises a pair of links 172 journaled on the pin 166 on opposite sides of the piston rod 164 and having their opposite ends straddling the rib 114 and being pivoted to the latter by a pivot pin 174 rotatably extending through an opening 176 through the rib 114 and having its opposite extremities welded to the links 172. The toggle linkage 170 also includes a pair of links 180 journaled on the pivot pin 166 at 182 so as to straddle the links 172 with the other ends of the links 180 being journaled at 184 on the pin 150 as shown in FIG. 9. The pivot pin 166 is preferably in the form of a headed pin removably secured in assembled condition by a compression split pin 190 so that the piston rod 164 can be disconnected if necessary.

Toggle linkages generally designated at 200 and 202 are provided, with the former comprising a horizontal transverse pivot pin 204 journaled through a transverse opening 206 through a boss fixed to the hydraulic cylinder 162, a pair of links 210 straddle the boss 208 and are journaled on the pin 204 as shown in FIG. 10, with the remote ends of the links 210 being welded to the opposite ends of a pivot pin 212 that is in turn journaled through a depending rib 214 welded to the hull 70.

Another pair of links 216 straddle the links 210 and are journaled upon the pivot pin 204 as shown in FIG. 10.

The remote ends of the links 216 are welded to the opposite extremities of the pivot pin 130 that is journaled through a spaced pair of plates 134 welded to the hull 40. It will be noted in FIG. 6 that the pin 212 is parallel to and directly overlies the pin 130. The pins 204, 212 and 130 are all horizontal and parallel to each other as well as being transverse with respect to the longitudinal extent of the power unit 12.

A pair of elongated actuator bars 230 straddle the links 216 and are journaled upon the pivot pin 204 as shown in FIG. 10. The pivot pin 204 is preferably a headed pin as shown and is releasably retained in assembled relation by a compressed split pin 232. The rear ends of the actuator bars 230 are apertured and journaled upon a transversely extending horizontal pivot pin 240 that constitutes a part of the toggle linkage 202 as shown in FIG. 11.

A pair of links 246 have their opposite ends journaled on the pivot pins 240 and 140. A second pair of links 248 have their opposite ends journaled upon the pivot pins 240 and 132.

The pin 240 is headed as shown and is releasably retained in position by a compressed split pin 250 so that the pin 240 can be removed.

The toggle linkages 200 and 202 are interconnected by a radius rod or stabilizer bar 260 that has its forward end disposed between the plates 134 and journaled on the pivot pin 130 as shown in FIG. 10. The rear end of the rod or bar 260 is journaled upon the center of the pivot pin 140.

Means are provided for limiting the rearward movement of the actuators 230 and the pivot pin 240 that may be occasioned by extension of the hydraulic power means 160. Such means comprises a pair of stop links 270 that are journaled on the pin 140 in straddling relation of the stabilizer bar 260, it being noted that such stop links 270 are coplanar with the links 248. A link 272 is journaled on the pin 132 intermediate the links 248 as shown in FIG. 11 with the links 270 and 272 all being journaled on a pivot pin 274 with the stop links 270 straddling the link 272. As clearly shown in FIGS. 6 and 7, the links 270 are provided with lateral extensions 276 that engage the links 248 when the latter and the links 270 swing sufficiently clockwise from the positions as shown thereof in FIG. 6.

Figure 7:
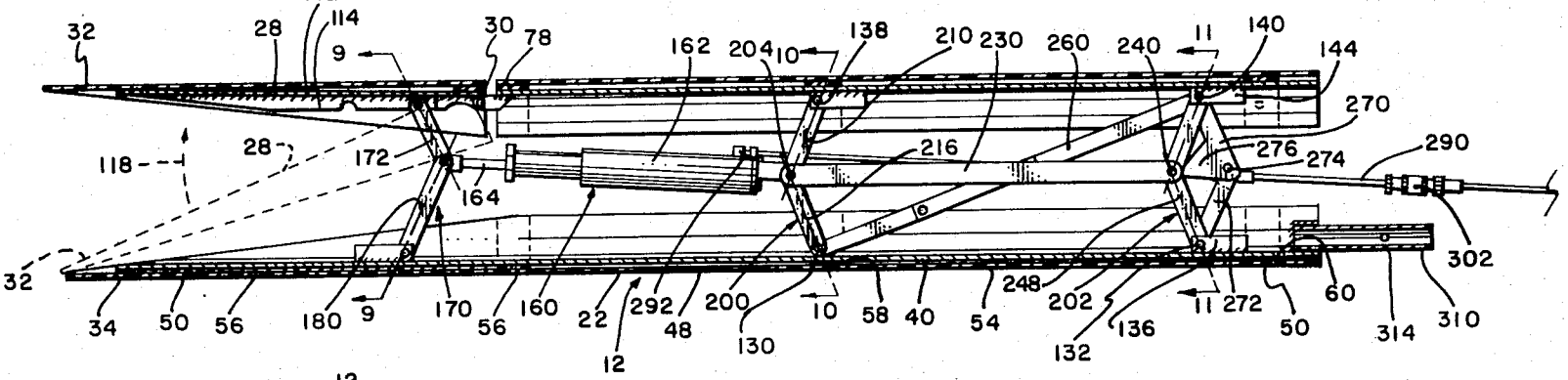
FIG. 7 is a view similar to FIG. 6 with the operating unit being in expanded condition.
Figure 8:
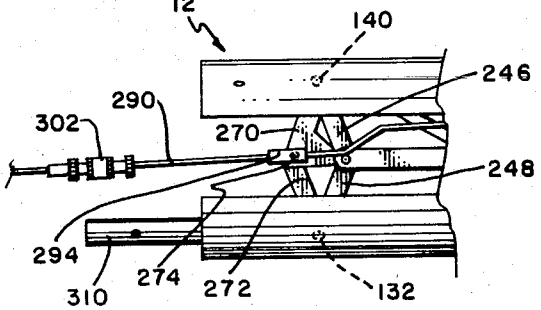
FIG. 8 is a fragmentary elevational view of the rear end of the operating unit when in its expanded condition, the view being from the side opposite to that shown in FIGS. 6 and 7.

Inspection of FIGS. 6 and 7 will make it evident that the orientations of the toggle linkages 170, 200 and 202 are such that extension of the hydraulic power unit 160 such as to force the pivots 166 and 204 tends to raise or cause upward pivotal motion of the nose segment 28 while concurrently tending to force the upper segment 26 upwardly, while the rod or bar 260 confines movement of the pivot 140 to an arc of relatively long radius that is substantially vertical so that endwise movement of the upper segment 26 is constrained. Also it will be evident that the links 270 and 272 are disposed so that upward extension of the toggle linkage 202 results in clockwise movements of the links 248 and 270 as viewed in FIGS. 6 and 7 so as to limit vertical extension of the toggle linkage 202 when the lateral extensions 276 engage the links 248 as shown in FIG. 7.

It will be manifest to those skilled in the art that, on extension of the hydraulic power unit 160, the relative extent of actuation of the toggle linkage 170 on the one hand and the toggle linkages 200 and 202 on the other hand will be dependent upon the relative opposition that such toggle linkages experience. In other words, the upward force exerted at any moment by either the nose segment 28 or the upper segment 26 is a function of the resistance or opposing force encountered by the other.

The hydraulic power unit 160 is conventional and is such that introducing hydraulic fluid into its cylinder through a metallic tubular conduit 290 and a port 292 causes extension of the piston rod 164 therefrom. The unit 160 is also conventional in that it is provided with internal spring means, not shown, that yieldingly urges retraction of the piston rod 164 with consequent return of hydraulic fluid to the conduit 290. Manifestly retraction of the piston rod 164 by the agency of the spring means lowers the nose and upper segments 28 and 26 to place the operating unit 12 in the collapsed condition shown in FIGS. 1 and 6.

A tubular guide 294 is carried by a nut and bolt constituting the pivot 274 and the hydraulic conduit slidingly extends through such guide 294, it being understood that the modest flexibility of the metallic conduit 290 coupled with the pivotal mounting of the guide 294 accommodates the motions of the hydraulic power unit 160 and serves to hold the conduit 290 out of harm's way, so to speak.

The hydraulic pump unit 14 is conventional and includes a handle 298 that may be manually oscillated vertically to force fluid from a pump reservoir 300 into the flexible hydraulic line 16 through a check valve, not shown. The unit also includes a normally-closed valve that bypasses the check valve so that fluid can return to the reservoir from the line 16. The lengthy flexible line 16 which can be readily coiled for convenient transport or storage is releasably connected to the hydraulic conduit 290 by a conventional quick hydraulic disconnect means 302, whereby the pump 14 and its line 16 can be quickly and conveniently connected to and disconnected from the operating unit 12 without entry of any air into the system or appreciable loss of hydraulic fluid.

Means are provided to enable the user of the operating unit to position and to orient the operating unit 12 however he wishes within a pipe, not shown, as well as to remove the same from the pipe. Such means comprises a tubular handle receptor 310 securely welded to the hull 40 so as to extend longitudinally rearwardly from the lower segment 22. The handle 20 has a lateral stud 312 intermediate its ends that is slidingly insertable into the handle receptor 310. The receptor 310 and the stud 312 have openings 314 and 316 therethrough that can be brought into alignment so that a small bolt can be passed through and detachably secured by a nut, such bolt and nut not being shown.

Inasmuch as connecting the handle 20 directly to the unit 12 will enable positioning the unit 12 a short distance into a pipe, the set of handle extenders 18 is provided. Inasmuch as each of the extenders 320 constituting the set 18 is identical to each other, a detailed description of one will suffice for all. The extender comprises an elongated member 322 having at one end a radially reduced portion or stud 324 that has the same size and shape as the handle stud 312 as well as an opening 326 corresponding to the opening 316. The end of the member 322 opposite the stud 324 is tubular or has a recess 328 therein sized to alternatively slidably accommodate therein the handle stud 316 or the stud 324 of another handle extender 320. Also the handle extender 320 is provided with an opening 330 therethrough that is analogous to the opening 314 in the handle receptor 310, whereby the handle 20 or any of the other handle extenders can be detachably coupled to the member 322 by use of a nut and bolt, not shown, applied in association with the opening 330 and one of the openings 326 or 316. In a similar manner, but use of a nut and bolt, not shown, any of the extenders 320 can be directly coupled to the handle receptor 310.

When the handle 20 is connected to the unit, with or without intervening extenders, it will be clear that the unit 12 can be pushed forwardly, pulled rearwardly, or rotated to any desired degree in either direction.

The use of the tool 10 will be readily understood. Damaged pipe or tubing is disposed with the damaged side up, and the operating unit 12, with the handle 20 and a suitable number of extensions attached thereto, is inserted until the nose segment 28 contacts the damage or until the upper segment 26 is directly underneath the damage. The hydraulic pump is then manually operated so as to extend or expand the hydraulic ram or hydraulic power means 160 with such expansion of the hydraulic ram causing upward movement of both the nose and upper segments 28 and 26 or such of these as affords the least resistance to the expansion of the hydraulic ram means 160, and such expansion will continue until the unit 12 is in the condition shown thereof in FIG. 7 or at some intermediate position limited by the diameter of the pipe. The arrangement is such that if the nose segment 28 first encounters damage, substantial forceful upward movement of the nose segment 28 will not occur until the upper segment 26 encounters the top of the pipe or tube with the result that reaction force of the damaged pipe against the nose segment 28 cannot cause rearward movement of the operating unit 12.

After the operating unit has reached the position shown in FIG. 7 or some intermediate position as limited by the diameter of the pipe or tubing, a hammer or preferably a heavy soft lead or rubber-headed mallet, not shown, is hammered against the damaged portion of the pipe or tubing to effect a final smoothing thereof with the nose and/or upper segment 28 and 26 serving as an internal anvil. If necessary, the bypass valve, not shown, of the hydraulic pump can be opened for an interval sufficient to free the operating unit 12 in the pipe and is thereafter closed, and the pump again operated after the operating unit 12 has been rotated as desired wihin the pipe. After one or more expansions of the operating unit 12 have been effected accompanied by any hammering deemed necessary, the bypass valve of the hydraulic pump can be opened to cause collapse of the operating unit 12 to the condition shown thereof in FIG. 6, after which the bypass valve is reclosed. The operating unit 12 may then be withdrawn from the repaired pipe or tubing or advanced forwardly to any remaining location of pipe damage upon extending the length of the handle as might be necessary.

When the optional boots are not used, the geometry of the various components of the operating unit 12 can conveniently be such that the vertical extent will approximately double when the same changes from its collapsed condition to its fully extended or expanded condition shown in FIG. 7. Consequently, an operating unit 12 of a given size can be used upon a wide range of pipe or tubing sizes. The use of the optional boots enables the operating unit 12 to be employed with even larger pipe or tubing and additionally, on selection of appropriately dimensioned bolts (a set of different sized boots can be supplied for given hulls), enables the operating unit 12 to be more comparable to the internal dimensions of the pipe or tubing undergoing repair and thereby serve as a better fitting anvil.

The invention is obviously susceptible to numerous variations or departures from the illustrated preferred embodiment of the same without departing from the spirit thereof. Exemplary of such an obvious departure would be the making of the external surfaces of the hulls or boots planar rather than convex whereby the operating unit could be applied to repair pipe or tubing of square or rectangular transverse section. In such suggested use the external configurations of the hulls or boots would be made conformable to rectangular configurations rather than cylindrical configurations, and the forward extremities of the lower and nose segments need only taper vertically rather than both vertically and laterally.

Having now fully described the invention and its use, attention is now directed to the appended claims in order to ascertain the actual scope of the invention.

I claim:

1. A pipe straightening tool comprising an elongated and horizontally extending unit that includes a lower segment having a lower external surface that is conformable to a downwardly convex cylindrical surface of a given diameter, said unit also including an upper segment parallel to and disposed directly above a rear portion of the lower segment and having an upper external surface that is conformable to an upwardly convex cylindrical surface of said diameter, means operatively connecting the upper segment to the lower segment for movement of the former between an elevated extended position and a depressed retracted position relative to the latter while maintaining such segments in parallelism to each other, a first means for urging movement of the upper segment toward its extended position, said upper and lower segments having an overall vertical extent that is less than said diameter when the former is in its retracted position, said unit also including an elongated nose segment directly overlying the forward portion of the lower segment and having a rear end pivotally connected to the front end of the upper segment for swinging movement thereof between a relatively raised position in which its upper external surface is conformable to the same upwardly convex surface as the upper segment and a relatively lowered position in which the nose section is inclined downwardly and forwardly from the forward end of the upper segment, a second means for urging movement of the nose segment from its lowered toward its raised position, and the nose segment and the portion of the lower segment disposed therebelow being tapered forwardly so that the forward end extremities of such segments are in relatively close proximity when the nose segment is in its lowered position.

2. The combination of claim 1, including means for urging the upper and nose segments respectively toward their retracted and lowered positions.

3. The combination of claim 1, wherein the first and second means are interconnected to cause the force urged by either of such means is a function of the resistance experienced by the other.

4. The combination of claim 1, wherein the first means comprises a spaced pair of toggle linkages connecting the upper and lower segments, an actuator operatively connected to the toggle linkages for actuating the latter in unison, with means for constraining the upper segment against endwise movement relative to the lower segment.

5. The combination of claim 4, wherein the last recited means comprises a radius rod having its extremities pivoted to the upper and lower segments, with said radius rod being horizontally inclined less than about 20°when the upper segment is in its retracted position.

6. The combination of claim 4, wherein a hydraulic power means is provided for forcing actuating movement of the acutator, and wherein the constraining means comprises a radius rod having its opposite extremities pivotally connected to the upper and lower segments.

7. The combination of claim 6, together with a plurality of elongated handle elements provided with means at their extremities enabling a selected number thereof to be detachably connected in endwise relationship, said unit being provided with means for detachable connection thereto of one of said handle elements so that the latter extends rearwardly therefrom, whereby the unit can be inserted into and removed from a pipe, and a hydraulic pump connected to the hydraulic power means by a flexible hydraulic fluid line.

8. The combination of claim 1, wherein the second means comprises a toggle linkage connecting the lower and nose segments, and an actuator operatively connected to said toggle linkage for actuating swinging movement of the nose segment about its pivotal connection to the upper segment.

9. The combination of claim 1, wherein the second means comprises a toggle linkage connecting the lower and nose segments, and an actuator operatively connected to said toggle linkage for actuating swinging movement of the nose segment about its pivotal connection to the upper segment, together with hydraulic power means for forcing actuating movement of the actuator.

10. The combination of claim 9, together with a plurality of elongated handle elements provided with means at their extremities enabling a selected number thereof to be detachably connected in endwise relationship, said unit being provided with means for detachable connection thereto of one of said handle elements so that the latter extends rearwardly therefrom, whereby the unit can be inserted into and removed from a pipe, and a hydraulic pump connected to the hydraulic power means by a flexible hydraulic fluid line.

11. The combination of claim 1, wherein the first means comprises a spaced pair of toggle linkages connecting the upper and lower segments, an actuator operatively connected to the toggle linkages for actuating the latter in unison, with means for constraining the upper segment against endwise movement relative to the lower segment, and wherein the second means comprises another toggle linkage that is connected between the nose segment and the lower segment, and a power means connecting and for varying the spacing of said another linkage and said actuator.

12. The combination of claim 11, wherein the power means comprises a hydraulic cylinder and piston rod combination having pivotal connections to said another linkage and to said actuator, the arrangement being such that a change in the spacing of the last recited pivotal connections in one sense urges the upper and nose segments toward their extended and raised positions respectively.

13. The combination of claim 12, together with means for yieldingly urging a change in said spacing in an opposite sense.

14. The combination of claim 13, together with a plurality of elongated handle elements provided with means at their extremities enabling a selected number thereof to be detachably connected in endwise relationship, said unit being provided with means for detachable connection thereto of one of said handle elements so that the latter extends rearwardly therefrom, whereby the unit can be inserted into and removed from a pipe, and a hydrulic pump connected to the hydraulic power means by a flexible hydrulic fluid line.

15. The combination of claim 1, together with means for selectively increasing the diameter of the cylindrical surfaces to which the upper, lower and nose segments are conformable, whereby a unit of a given size can be applied to repair pipe of differing sizes, with the last recited means comprising lower, upper and nose boots detachably secured to the lower, upper and nose segments respectively.

* * * * *